US005698812A

United States Patent [19]

Song

[11] Patent Number: 5,698,812

[45] Date of Patent: Dec. 16, 1997

[54] THERMITE DESTRUCTIVE DEVICE

[75] Inventor: Eugene Song, Ellicott City, Md.

[73] Assignee: The United States of America as represented by the Secretary of the Army, Washington, D.C.

[21] Appl. No.: 606,514

[22] Filed: Feb. 23, 1996

[51] Int. Cl.[6] ..... F42B 12/44

[52] U.S. Cl. ..... 102/364; 102/283

[58] Field of Search ..... 102/364, 365, 102/307, 482, 283, 284, 285

[56] References Cited

U.S. PATENT DOCUMENTS

| | | | |
|---|---|---|---|
| H464 | 5/1988 | Lee et al. | 102/364 |
| 2,253,364 | 8/1941 | Cohen | 102/364 |
| 2,391,242 | 12/1945 | Hurrey | 102/364 |
| 2,791,178 | 5/1957 | Thompson | 102/365 |
| 3,045,349 | 9/1962 | Plumley | 102/364 |
| 3,291,050 | 12/1966 | Ahlert et al. | 102/364 |
| 3,457,860 | 7/1969 | Allen | 102/364 |
| 3,736,878 | 6/1973 | Guntermann | 102/364 |
| 3,961,579 | 6/1976 | Faber et al. | 102/364 |
| 4,216,721 | 8/1980 | Marziano et al. . | |
| 4,237,787 | 12/1980 | Wacula et al. | 102/364 |
| 4,419,936 | 12/1983 | Coates et al. | 102/364 |
| 5,269,224 | 12/1993 | Gonzales et al. | 102/288 |

OTHER PUBLICATIONS

DTIC Report No. AD-393476, "Thermite Destructive Device" by Stanley Rodney, Sep. 1968.

*Primary Examiner*—Michael J. Carone
*Assistant Examiner*—Christopher K. Montgomery
*Attorney, Agent, or Firm*—Ulysses John Biffoni

[57] ABSTRACT

A destructive device containing a thermite-type composition having a core burning configuration. The device comprises a housing having a top, a bottom, and a thermally insulated liner to maximize the thermal effectiveness of an ignition. The bottom has a circumferential skirt and defines one orifice therein for directing the expulsion of the thermite-type-composition upon ignition, the top has vents which together with the bottom orifice and skirt balance the escape of gas and prevent the device from moving during ignition.

22 Claims, 1 Drawing Sheet

THERMITE DESTRUCTIVE DEVICE

GOVERNMENTAL INTEREST

The invention described herein may be manufactured, used and licensed by or for the United States government.

FIELD OF THE INVENTION

This invention relates to destructive devices using thermite reactions and in particular concerns improved means of utilizing such reactions in the destruction of metallic targets.

BACKGROUND OF THE INVENTION

For unconventional warfare activities requiring the destruction of machinery and metallic structures, an operational need exists for a device of such simple construction that the user has only to place it in position, start his time delay, and leave. From a tactical standpoint, high heat flux materials such as thermite have the greater advantage of silence; in contrast, high explosives would, without fail, arouse attention in the vicinity of the target area. From an operational and logistic standpoint, a device that is smaller and lighter is a must to assist in lightening the load carried by the soldier and to reduce the number of resupply missions.

The methods and apparatus of this invention are useful in a variety of sabotage or other applications including, but not limited to, the destruction of metallic targets by cutting through the casing steel (up to 1 inch thick with 0.75 pound payload) and fusing the components contained therein, for example, gears, pistons, or shafts with a stream of molten iron at 4500° F. It has unlimited uses for attacking and destroying transformers, generators, electric motors, engine blocks, gun barrels, breech blocks, and mines. Storage tanks or drums can be cut through, causing the contents to flow out. If the liquid is flammable a fire and deflagration will result.

Thermite, one of the most common pyrotechnic incendiary agents, is essentially a mixture of powdered ferric oxide and powdered or granular aluminum. When raised to its ignition temperature an intense reaction occurs whereby the oxygen in the ferric oxide is transferred to the aluminum, producing molten iron, aluminum oxide, and releasing 750 kilocalories per gram. A standard thermite reaction is shown as follows:

$$8\ Al + 3\ Fe_3O_4 \rightarrow 4\ Al_2O_3 + 9\ Fe$$

This exothermic reaction may produce a temperature of about 3000° C. under favorable conditions. The white-hot molten iron and slag may itself prolong and extend the heating and incendiary action.

Other types of thermite mixtures containing metals and the oxides of other metals other than iron oxide are known: aluminum/manganese oxide ($4\ Al + 3\ MnO_2$); aluminum/chromium oxide ($2\ Al + Cr_2O_3$) and others. Aluminum/iron oxide mixtures ($8\ Al + 3\ Fe_3O_4$) have proved to be the most effective incendiary composition for destruction of steel targets because superheated liquid products are formed by the reaction. These molten products affect a high rate of conductive heat transfer to the steel target and, therefore, cause destruction of the target. Any combination metal/metal oxide capable of high rates of conductive heat transfer can be used in the present invention.

However, because of the great difficulty in igniting aluminum/iron oxide mixtures and the almost complete absence of gaseous reaction products, which causes flameless burning and a small radius of action of the hot thermite, aluminum/iron oxide is not used alone as an incendiary mixture. It is used in multicomponent thermite incendiary compositions, in which another oxidizer and binder are together included. THERMATE-TH3, a mixture of aluminum and iron oxide and other pyrotechnic additives, was found to be superior to aluminum and iron oxide alone and was adopted for use in incendiary hand grenades. Its composition by weight is aluminum/iron oxide 68.7%, barium nitrate 29.0%, sulfur 2.0% and binder 0.3%. The addition of barium nitrate increases the thermal effects, creates flame in burning and reduces the ignition temperature.

Prior to the development of this invention, no incendiary grenade or device, utilizing a thermite charge less than or equal to 0.75 pound in weight, was capable of penetrating 1 inch thick steel plate with a container less than or equal to three-quarters the size of the AN-M14 TH3 incendiary hand grenade. The M14 grenade is generally cylindrical in shape with a 2.5 inch diameter by 4.5 inch height.

The most basic thermite grenade design is that of the AN-M14 TH3. It contains 1.5 pounds of thermate-TH3 which releases approximately 795 kilocalories per gram of uncontrolled energy through the thin walls of its sheet metal body. This energy, however, being undirected, is highly inefficient and insufficient to produce reasonable penetration levels.

A device with greater penetration capabilities is the "Thermite Penetrator Device" of U.S. Pat. No. 4,216,721 herein incorporated by reference, which was designed to direct the flow of energy through an opening at the bottom of the containing vessel. However, it is still inefficient in that a great amount of its energy is being lost through its open top end. The open top not only reduces the energy available for penetration, but adds to the device's visible signature.

A 1968 study performed for Frankford Arsenal resulted in a prototype design which incorporated a vented plug at the back end of the thermite device. The plug greatly reduced the amount of energy being lost and created pressure increases within the device. The study credited the increased penetration to a large void air space above the thermite charge which moderates the pressure buildup within the device which in turn produces an optimum flow of the molten iron. Such a device is described in the Defense Technical Information Center (DTIC) report by AD-393476 entitled "Thermite Destructive Device" by Stanley Rodney, September, 1968.

While the Frankford Arsenal design has merit, and a 1.5 pound charge of thermite could penetrate 1 inch thick steel plate, it is still insufficient with respect to thermite mass efficiency, to produce reasonable penetration levels. These devices also require the large void air space within the device cavity which makes the device too large (3" diameter×12" height), approximately four (4) times larger in size over the current system, AN-M14. Furthermore, the device requires means for locking the device onto a target.

SUMMARY OF THE INVENTION

The present invention relates to a destructive device comprising a housing having a tightly fitting top and bottom. The bottom has a hole therein through which the burning thermite is expelled from the housing and a skirt which creates space between the bottom of the housing and the object upon which the housing is seated. The top has vent holes therein to cooperate with the bottom hole to balance gas escape so that the housing is not moved during ignition from the object upon which the housing is seated. The housing has a thermal insulation liner to maximize the effectiveness of the thermal output, and contains a thermite-type composition having a hollow core therethrough with a liquid slurry ignition material wetting the core and a powdered starter material pressed on top of the thermite-type composition to create a core burning configuration.

It is, therefore, an object of this invention to provide means for utilizing thermite reactions such that optimum penetration of metallic targets is achieved, with respect to mass and size efficiencies.

It is further an objective of this invention to provide a small and lightweight incendiary device that is capable of destroying machinery and metallic structures, igniting fuel cells, or starting fires.

It is another objective of this invention to provide a manually emplaced or hand thrown incendiary device that is capable of destroying machinery and metallic structures, igniting fuel cells, or starting fires.

DETAILED DESCRIPTION OF THE PREFERRED EMBODIMENT

Figure 1:
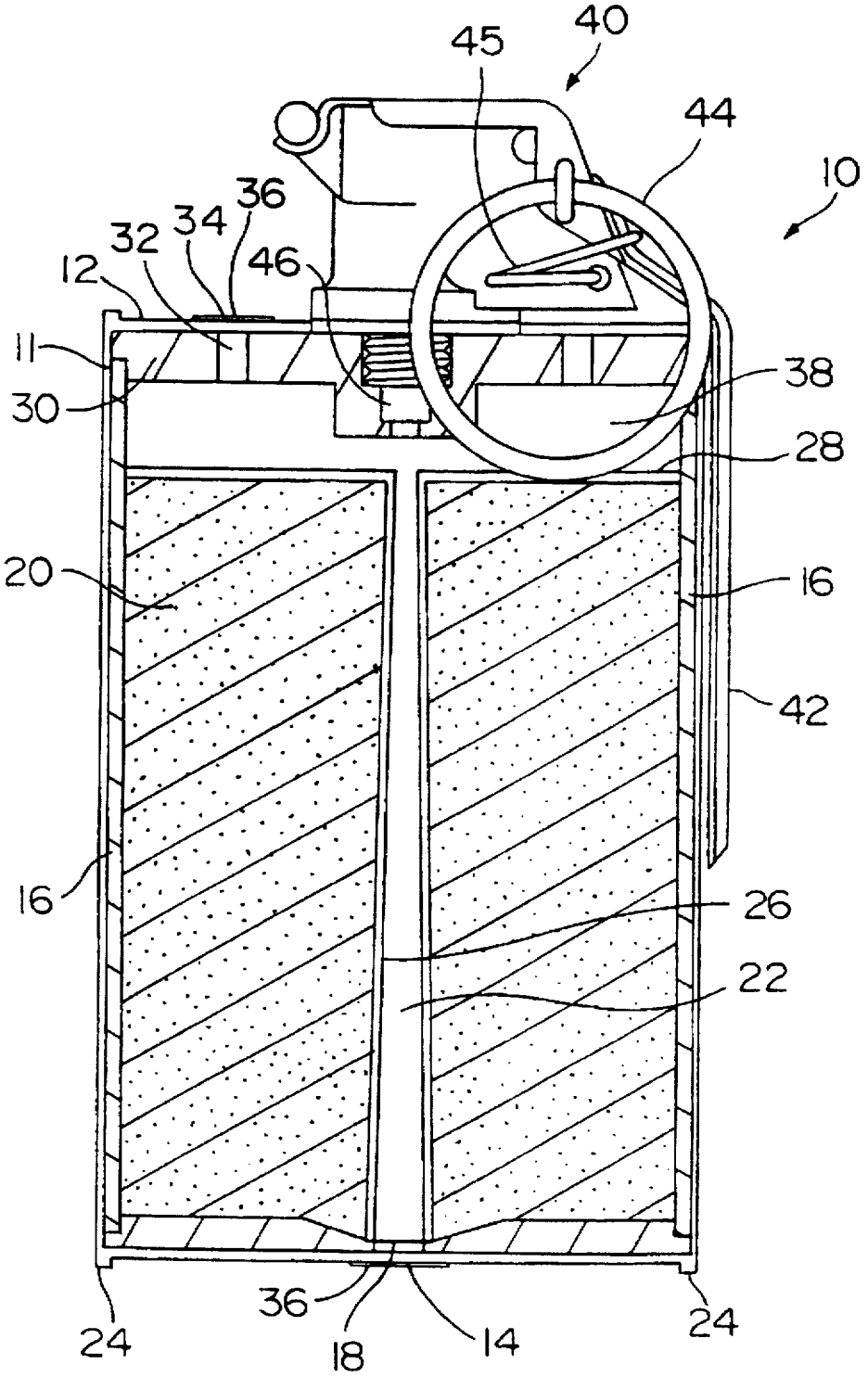
FIG. 1 shows the internal structure of the device and the charge configuration utilized in the present invention.

Referring to FIG. 1, the grenade body 10 comprises a housing 11 and a top or lid 12 which may be constructed of any suitable material able to withstand the effects of rough handling, e.g., sheet metal or plastic. The housing 11 has an exit hole 14 in the bottom, and contains an insulation liner 16, made of graphite or other refractory material capable of withstanding the reaction temperature of the specific thermite selected. The liner 16 has an orifice or a nozzle 18 at the bottom. The diameter of this hole is between ⅛–½ inch and is preferably ½ inch. A thermite charge 20 preferably of the $Fe_3O_4$ and Al type described above, is consolidated into the insulated housing 11 such that a hollow core 22 extends downward along the entire length of the charge. Illustrative but without limitation, the consolidation may be conducted in several increments by alternately loading less than complete amounts (i.e., less than a full charge) of the thermite in the insulation liner and, using a commercially available press capable of generating a consolidation pressure preferably in the range of 3,000 to 4,000 psig, compressing the thermite. Alternate loading and pressing will assure a uniform and compact thermite charge. Illustrative but without limitation, the hollow core 22 comprises a conically-shaped channel having base and top diameters of ½ inch and ⅜ inch, respectively and a longitudinal axis. Preferably, the longitudinal axis of the core 22 and the liner 16 of the destructive device are one in the same. This core is formed by removing a conical spindle, installed through nozzle 18 into the liner prior to thermite loading and compaction, after complete thermite loading and compaction. A starter material in the form of slurry 26 is poured into the core 22, and a powdered starter material 28 is pressed on top of the thermite charge. The starter materials 26 and 28 may be any material readily ignitable upon application of flame, or lighted fuse. The starter should also have sufficient thermal output to reliably ignite the thermite charge 20. A powdered starter material 28, for example, will preferably comprise by weight, the following ingredients:

| | |
|---|---|
| Potassium Nitrate | 66.69% |
| Titanium | 14.96% |
| Silicon | 7.78% |
| Aluminum | 8.67% |
| Binder | 1.99% |

Slurry 26 is produced by adding eight percent by weight of nitrocellulose to acetone and then mixing twenty grams of the powdered starter material above with fifteen grams of the acetone/nitrocellulose solution.

A vented plug 30, made of graphite or other refractory material capable of withstanding the reaction temperature of the specific thermite selected, having a plurality of vent holes 32, fits onto the top of the insulation liner 16. The vented plug 30 acts as a baffle for the exit of molten product materials and also acts as a radiation shield and thus helps retain the heat produced. By designing destructive devices so that the diameters of vent holes 32 and a nozzle 18 are of different sizes, it is possible to release the molten products of reaction at a rate which balances gas escape and distributes the forces so that the burning thermite jet does not move the device off the target.

Vent plug 30 may have three to four vent holes 32 with diameters ranging from ⅛ to ⅜ inch. When the diameter of bottom hole 14 is ½ inch, preferably the vent plug should have three holes with diameters of 0.2344 inches.

The top or lid 12 has holes 34 matching vent holes 32 and the lid is fitted tightly onto the housing by any conventional means, e.g., crimping. The lid holes 34 in the top and the exit hole 14 in the bottom of the device are sealed from outside by a thin metal adhesive disc or foil 36, preferably aluminum, thereby denying any moisture to migrate inside the grenade body 10. Of course, any appropriate sealing can be applied so long as the burning thermite burns or unseats the discs.

A standoff or skirt 24 at the bottom of the device ensures a separation between the bottom exit hole 14 and the material under attack so that the burning thermite jet produced does not move the container off the target.

The safety fuse assembly 40 shown in the figure may be any type which is capable of igniting the starter materials 26 and 28 which in turn ignite the thermite charge 20. The fuse 40 should desirably have safety lever 42, safety pin 44, and safety clip 45. The safety clip 45 prevents the safety lever 42 from springing loose even if the safety pin 44 is accidently removed. A time delay element 46 in the fuse assembly 40 should desirably be a slow burning material of about 10–15 seconds/inch, and is suitably of approximately 1.2 g of Type III Zr-Ni delay composition which will provide the approximate desired rate of burning. Of course, faster burning materials are equally usable with the device if a sufficient delay time is provided so that the operator will have sufficient time to remove himself from the vicinity after igniting the delay mix.

The core burning configuration 22 allows the ignition to take place from the core defined by the thermite charge and at the top of the thermite charge, which causes the reaction front to progress both radially and downwardly through the thermite charge, thus permitting the molten mass to be pushed out of the orifice 18 immediately upon ignition until completion of the reaction. This burning results in a jetting of molten products, rather than a flowing molten mass, which penetrates the metal target for optimum damage. A small air space 38 above the thermite charge 20, suitably about 0.5-inch in height, along with the vented plug 30 provide some restriction of the expanding gases within the device which results in enough pressure increase to aid in the jetting of the molten reaction products.

It is apparent from the above description that an improved thermite destructive device has been provided which incorporates three unique and new features, namely:

(1) A core burning design with orifice/nozzle at the base directing the jet at the target.

(2) Balanced gas escape design, including a vented plug at the top, and an orifice and skirt at the bottom which distributes the forces so that the burning thermite jet does not move the container off target.

(3) Thermal insulated container design to maximize thermal effectiveness of the output.

The combined design features yields jetting molten products rather than flowing molten mass to penetrate the metal target for optimum damage. The device does not require a large void volume which would make the device very large and the design also reduces the amount of payload.

Utilizing the present invention, a steel plate 1 inch in thickness was completely burned-through using 0.75 pound thermite charge within a container three-quarters the size of the M14 package which contains double the thermite.

Although the invention has been described with a certain degree of particularity, and a preferred embodiment has been set forth, it is to be understood that the invention is not limited to the exact details of construction shown and described, but is only limited by the subject matter recited in the appended claims which subject matter includes equivalents and obvious variants thereof which will occur to a person of ordinary skill in the art.

What is claimed is:

1. A destructive device, comprising:

(a) a housing having a top, a bottom, and a thermally insulated liner to maximize the effectiveness of thermal output; and (b) a thermite incendiary composition having a core-burning configuration contained in said housing, wherein said core-burning configuration comprises a hollow core extending downward along the length of the composition; said bottom of said housing having a circumferential skirt and defining one orifice therein for directing the expulsion of said thermite incendiary composition upon ignition, and said top having venting means which together with said orifice balance the escape of gas and prevent the device from moving during ignition.

2. The device of claim 1, wherein said incendiary composition comprises a metal and a metal oxide.

3. The device of claim 2, wherein said incendiary composition comprises a metal and a metal oxide selected from the group consisting of: $Al/Fe_3O_4$, $Al/Cr_2O_3$ and $Al/MnO_2$.

4. The device of claim 2, wherein said incendiary composition comprises $Al/Fe_3O_4$, and wherein said composition further includes barium nitrate, sulfur and a binder.

5. The device of claim 1, wherein said incendiary composition having a core-burning configuration comprises a consolidated pack of thermite having a hollow core, so that when ignited said core configuration generates a focused jet of molten metal.

6. A destructive device, comprising:

(a) a housing having a bottom, said bottom defining a hole therein;

(b) a top attached to said housing, said top having vent holes therein;

(c) an insulation liner contained within said housing, said liner having a vented plug top, and a bottom, said liner vented plug top having holes substantially in alignment with said vent holes in said top, and said liner bottom having a hole substantially in alignment with said hole in said bottom;

(d) a thermite incendiary composition within said liner, said composition having a top and defining a hollow core therethrough, said composition having an inner surface at said hollow core, said composition thereby having a core-burning configuration so that when ignited said composition burns radially outward and axially downward thereby generating a focused jet of molten metal through said hole in said bottom;

(e) ignition material on said inner surface at said hollow core and on said top of said incendiary composition; and (f) means for separating the bottom of the housing from an object upon which the housing rests.

7. The device of claim 6, wherein said liner vented plug top and said ignition material on the top of said incendiary composition define an air space therebetween.

8. The device of claim 6, wherein said ignition material on the inner surface of said composition at the core comprises a slurry.

9. The device of claim 6, wherein said thermite incendiary composition is consolidated by pressure compaction within said liner and the hollow core defined by the consolidated composition is elongated and conical with the greater diameter of the core at the bottom of the destructive device.

10. The device of claim 6, further including foil covers for the vent holes in said top and the hole in said bottom of said housing.

11. The device of claim 6, wherein said housing and said top are constructed of plastic.

12. The device of claim 6, wherein said housing and said top are constructed of metal.

13. The device of claim 6, wherein said separating means comprises a circumferential skirt.

14. The device of claim 6, wherein said insulation liner is made of refractory material capable of withstanding the reaction temperature of incendiary composition.

15. The device of claim 14, wherein said refractory material is graphite.

16. The device of claim 6, wherein said top fits securely to the housing.

17. The device of claim 16, wherein said top and said housing are crimped together.

18. The device of claim 6, wherein the incendiary composition comprises a metal and a metal oxide.

19. The device of claim 18, wherein the incendiary composition comprises a metal and a metal oxide selected from the group consisting of: $Al/Fe_3O_4$; $Al/Cr_2O_3$ and $Al/MnO_2$.

20. The device of claim 19, wherein the incendiary composition comprises $Al/Fe_3O_4$.

21. The device of claim 20, wherein the incendiary composition further comprises barium nitrate, sulfur and a binder.

22. The device of claim 6, wherein said ignition material on the surface of the incendiary composition defining the core is a liquid slurry and the ignition material on top of the incendiary composition is a powder, said slurry and powder comprising potassium nitrate, titanium and aluminum.

* * * * *